US006779678B2

(12) United States Patent
Baron

(10) Patent No.: US 6,779,678 B2
(45) Date of Patent: Aug. 24, 2004

(54) PLASTIC BOTTLE WITH EXTENDABLE INTERNAL SUPPORT

(75) Inventor: Richard D Baron, Zephyrhills, FL (US)

(73) Assignee: Vitality Foodservice, Inc., Tampa, FL (US)

( * ) Notice: Subject to any disclaimer, the term of this patent is extended or adjusted under 35 U.S.C. 154(b) by 0 days.

(21) Appl. No.: 10/341,988

(22) Filed: Jan. 14, 2003

(65) Prior Publication Data

US 2004/0134920 A1 Jul. 15, 2004

(51) Int. Cl.[7] ..... B65D 1/42
(52) U.S. Cl. ..... 220/653
(58) Field of Search ..... 220/653

(56) References Cited

U.S. PATENT DOCUMENTS

| | | | | | |
|---|---|---|---|---|---|
| 1,045,510 | A | | 11/1912 | Campbell | |
| 2,407,455 | A | | 9/1946 | Shakesby et al. | 220/71 |
| 3,940,002 | A | | 2/1976 | Schiemann | 215/1 C |
| 4,399,850 | A | * | 8/1983 | Schiemann | 220/653 |
| 4,609,106 | A | | 9/1986 | Gentili | 206/509 |
| 4,969,922 | A | | 11/1990 | Platte, Sr. | 215/1 C |
| D355,854 | S | | 2/1995 | Baron et al. | D9/528 |
| 5,456,379 | A | * | 10/1995 | Krupa et al. | 220/835 |
| 6,135,306 | A | | 10/2000 | Clayton et al. | 220/564 |
| 6,270,488 | B1 | | 8/2001 | Johnson et al. | 604/403 |
| 6,338,420 | B1 | | 1/2002 | Pachciarz et al. | 220/562 |
| 6,689,435 | B2 | * | 2/2004 | Iwasaki | 428/34.1 |

* cited by examiner

*Primary Examiner*—Joseph Man-Fu Moy
(74) *Attorney, Agent, or Firm*—Carlton Fields, P.A.

(57) ABSTRACT

A molded plastic bottle of generally parallelepiped configuration and having two opposing sides has an integrally molded reentrant beam support extending inwardly of the bottle and engaging the other opposing side, with that support including a flexible portion to permit a limited amount of deflection of the two opposing sides toward or away from one another.

11 Claims, 4 Drawing Sheets

FIG. 4
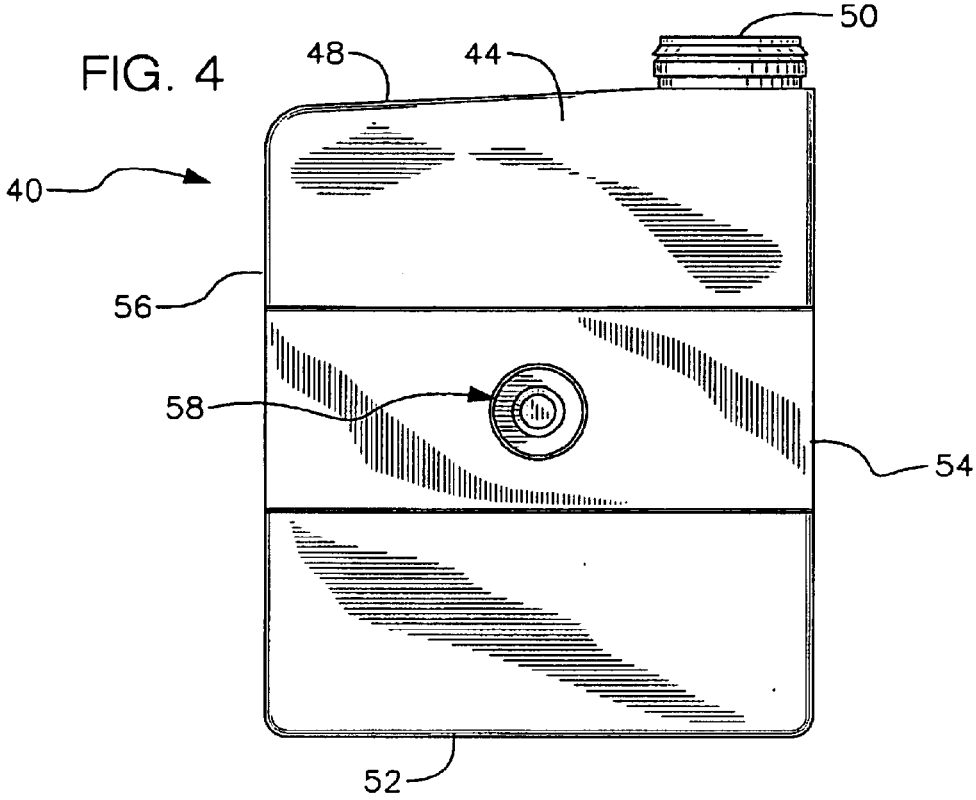
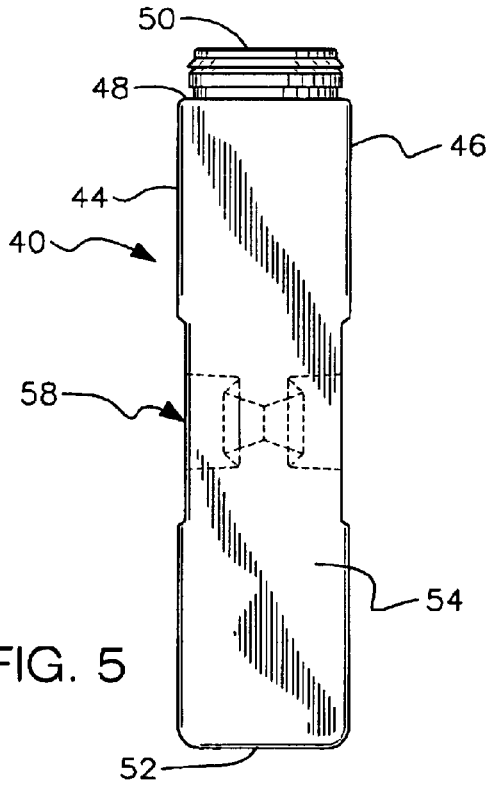
FIG. 5
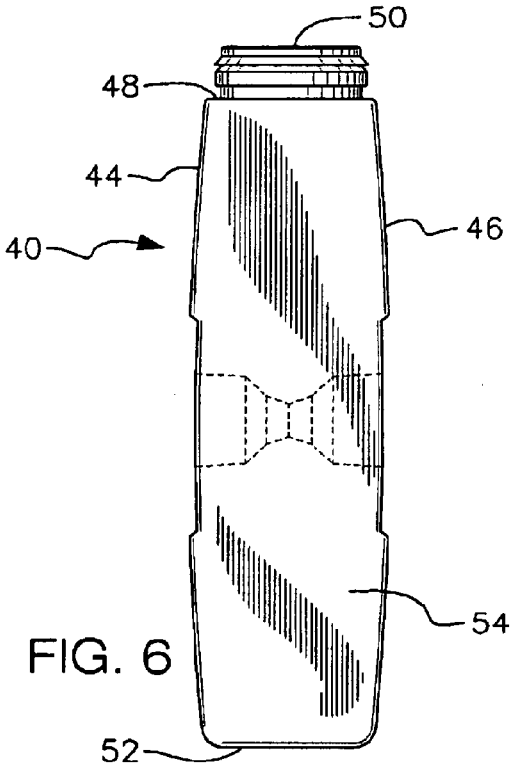
FIG. 6

PLASTIC BOTTLE WITH EXTENDABLE INTERNAL SUPPORT

BACKGROUND OF THE INVENTION

This invention relates generally to the manufacture and configuration of bottles, in particular, thin walled plastic bottles of generally parallelepiped configuration. In such bottles, particularly those having generally flat sides, there has long been a problem of the sides bowing outwardly, not only under the static pressure of the liquids contained within, but also in the event of either freezing of the liquid contained therein, or in the event of the fully loaded model being dropped.

In some prior art bottles, such as that disclosed in my U.S. Pat. No. D355,854, and in Platte, Sr. U.S. Pat. No. 4,969,922, additional stiffness and support for the sidewall is provided by reentrant beams molded into and extending inwardly of the sidewall in mutually opposed relationships and bonded together in the center of the bottle. While this has provided additional stiffness, it has been found that such fixed, bonded reentrant beams, when subjected to the pressures of freezing liquid within the bottle or a fully loaded bottle being dropped, may fracture, thus losing the stiffness and potentially causing leakage in the bottle.

SUMMARY OF THE INVENTION

In order to overcome the deficiencies of the prior art, this invention provides a molded plastic bottle of generally parallelepiped configuration having two opposed sides, a top with an opening, a bottom and two ends, with at least one of the two opposing sides having integrally molded therewithin a reentrant beam support extending inwardly of the bottle and engaging the other such opposing side to provide support against deflection of the opposing sides relative to one another. This support includes a first portion adjoining that one side of the bottle and being of generally cylindrical configuration, with an annular, flexible portion joining that cylindrical portion to a support extremity of a smaller cross section than the first portion. That support extremity engages the other opposing side of the bottle, whereby the flexible portion of the support permits a limited amount of deflection of the two opposing sides toward or away from one another, while restraining excessive such movement.

BRIEF DESCRIPTION OF THE DRAWINGS

A particularly preferred embodiment of the bottle of this invention, along with an illustration of a prior art bottle, is shown in the drawings in which:

FIG. 4 is a side elevation of a preferred embodiment of the bottle of this invention;

FIG. 5 is an end view of the bottle of FIG. 4, showing the flexible support beam in phantom;

FIG. 6 is an end view corresponding to FIG. 5, but showing the bottle in an expanded state;

DESCRIPTION OF A PREFERRED EMBODIMENT

Figure 1:
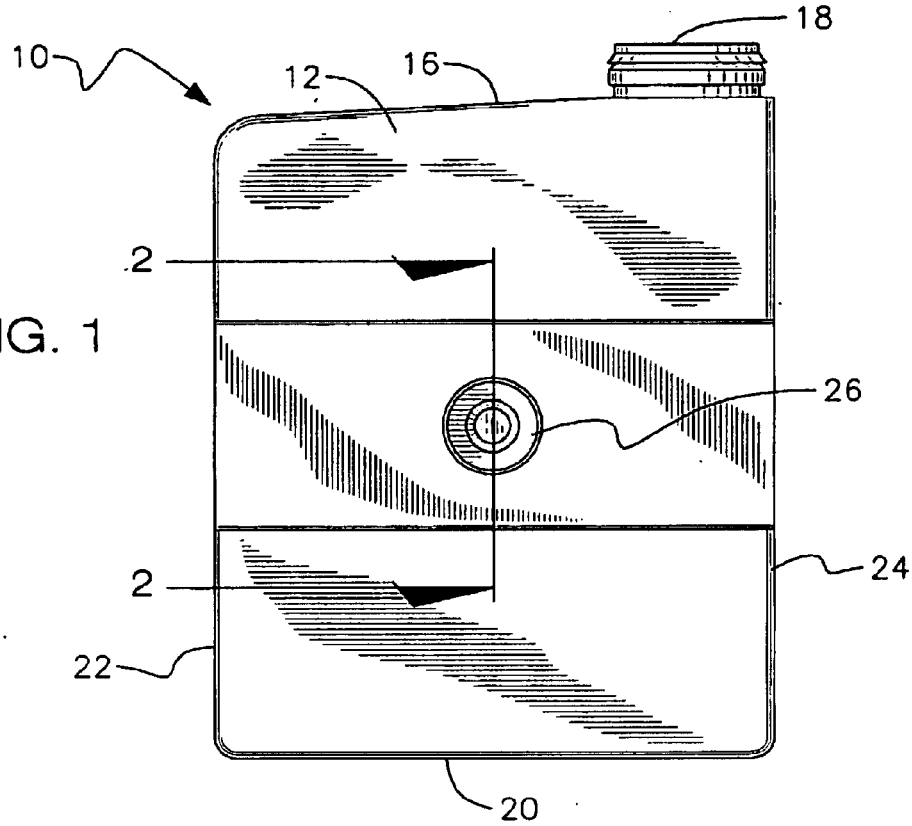
FIG. 1 is a side view of a prior art bottle having a conventional pair of mutually opposed reentrant beam supports.
Figure 2:
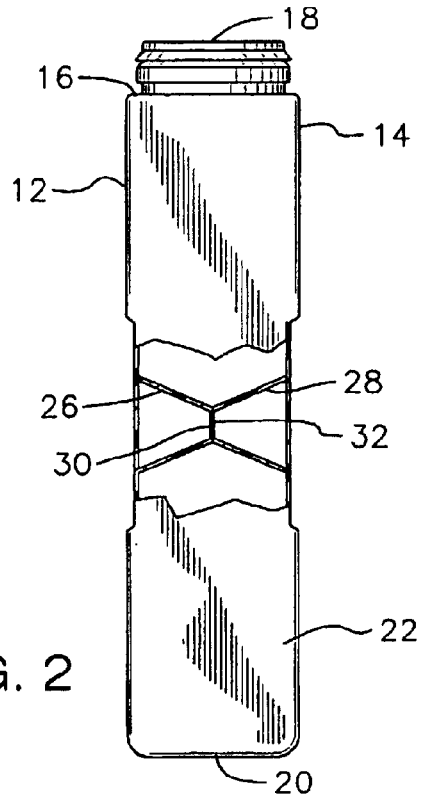
FIG. 2 is an end sectional view of the bottle of FIG. 1, taken along section line 2—2 of FIG. 1, to show more clearly the configuration of the reentrant beam supports.
Figure 3:
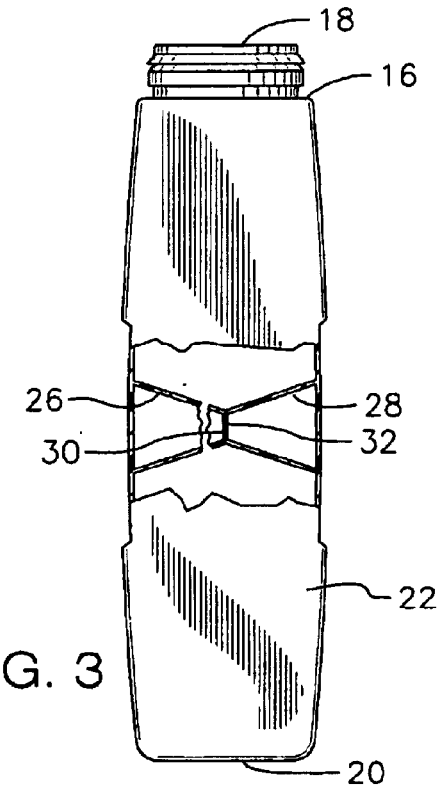
FIG. 3 is an end sectional view corresponding to that of FIG. 2, but illustrating the problem associated with the prior art supports when a force urges the broad sidewalls of the container outwardly, rupturing the support beam.

In FIGS. 1 through 3 are illustrated a prior art bottle having conventional reentrant beam supports formed in the two opposing sides. Specifically, the bottle 10 in FIG. 1 is a molded plastic bottle of generally parallelepiped configuration having two opposed sides 12 and 14, a top 16 having an opening 18, a bottom 20 and two ends 22 and 24. The support structures 26 and 28 are formed in the sidewalls 12 and 14, respectively, with those supports having a generally frusto-conical configuration and with the mating bases of the frusto-conical portions 30 and 32, respectively, being bonded together to provide the desired support against deflection of the sidewalls 12 and 14.

Under nominal conditions, the support structure provides satisfactory support to prevent deflection, either inwardly or outwardly, of the sidewalls 12 and 14, in the manner shown in FIG. 2. However, as shown in FIG. 3, when there is substantial outward pressure of the sidewalls 12 and 14, as by freezing a liquid contained within the bottle, or by the loaded bottle being subjected to unexpected shock loading, as may occur when it is dropped, there is little or no resilience to the supports 26 and 28. Accordingly, under such loading, one of those supports may fracture, as shown in FIG. 3, or the bond between the respective bases 30 and 32 may be broken. In either event, the support against outward deflection of the walls is lost, and it may occur that the integrity of the sidewall is broken, permitting leakage of the contents.

The remaining FIGS. 4 through 8, illustrate a preferred embodiment of the present invention. As with the bottle 10 of FIGS. 1 through 3, in this preferred embodiment, the bottle 40 is preferably a molded plastic bottle of generally parallelepiped configuration having two opposed sides 42 and 46, a top 48 with an opening 50, a bottom 52 and two ends 54 and 56. The support structure, generally indicated by reference number 58, is shown in greater detail in the end sectional view of FIG. 7.

Figure 7:
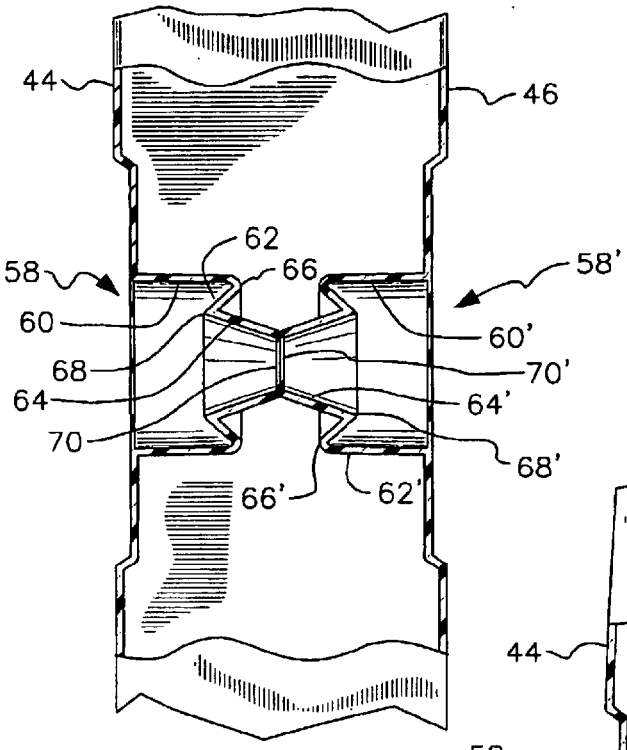
FIG. 7 is an end sectional view on an enlarged scale, taken along section line 7—7 of FIG. 4, and corresponding generally to the view of FIG. 5.

In FIG. 7 this support, suitably in the form of a reentrant beam molded integrally with the side 44 of the bottle, is seen extending inwardly of the bottle and engaging the other, opposing side 46. In this embodiment, that opposing side 46 may likewise have such a reentrant beam support molded integrally therewithin and extending inwardly of the bottle to meet and be bonded with the other such support. Of course, if preferred, the bottle could be formed with a generally flat opposing side 46 with that first beam support 58 configured to extend all the way across to engage such flat side portion 46.

In FIG. 7 the support 58 is shown in greater detail. The support includes a first portion 60 adjoining the side 44 and being of generally cylindrical configuration, and suitably of frusto-conical configuration, with an annular, flexible portion 62 joining that first portion 60 to a support extremity 64 of a smaller cross section than that first portion 60. This support extremity 64, suitably of frusto-conical configuration engages the other side of the bottle. In this embodiment, the support 58 engages a corresponding support 58' formed integrally with the opposing side 46. The corresponding portions of this opposing support 58' are provided with the same reference numeral, differentiated by the inclusion of the prime notation (').

In the support 58, the flexible portion 62 includes at least one fold line 66, and preferably a plurality of such fold lines, such as fold lines 66 and 68. The end of the support extremity 64 includes a base 70 closing the smaller diameter end of the frusto-conical portion 64. This base portion 70 is bonded to the opposing side 46, and this embodiment, to the base 70' of the opposing molded support. Conveniently, these bases 70 and 70' may be heat bonded at the time of formation of the bottle.

Figure 8:
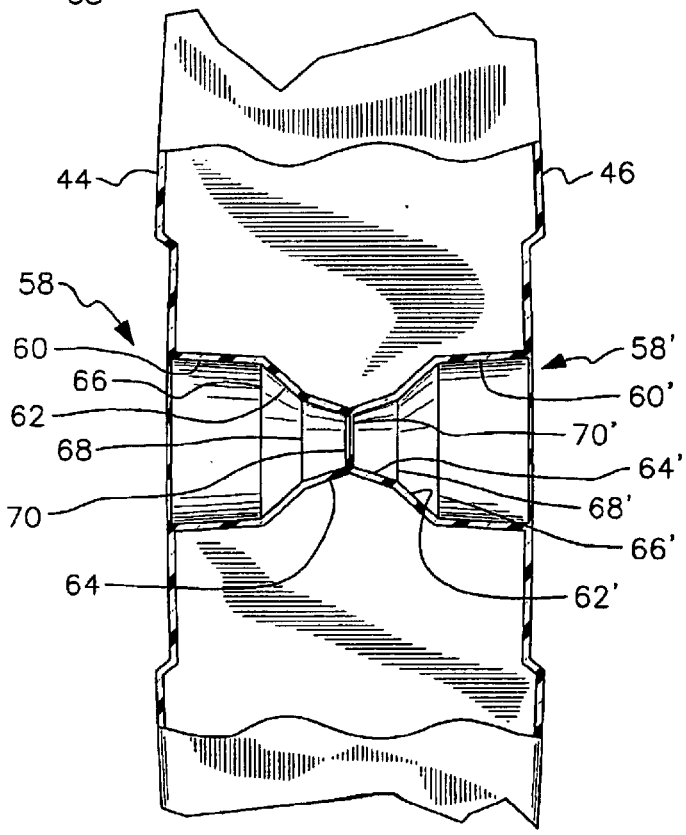
FIG. 8 is a sectional view similar to that of FIG. 7, but illustrating the bottle in its expanded configuration, to more clearly illustrate the functioning of the flexible support.

FIG. 8 illustrates the results of expansion of the sidewalls 40 and 46 away from one another while using the support structure shown in FIG. 7. In this configuration, the flexible portion 62 has deflected about fold lines 66 and 68 to enable the support extremity 64 to move away from the first portion 60 of that support by providing for this flexibility and movement of the support extremity 64 from the first portion 60. A limited amount of deflection of the two opposing sides 44 and 46 may be accommodated without the rupture experienced by prior art structures, as shown in FIG. 3 above. It is also possible that, after the event causing the outward deflection of the opposing sides 44 and 46, the support may return to its original position, illustrated in FIG. 7, or it may remain extended as shown in FIG. 8.

Figure 9:
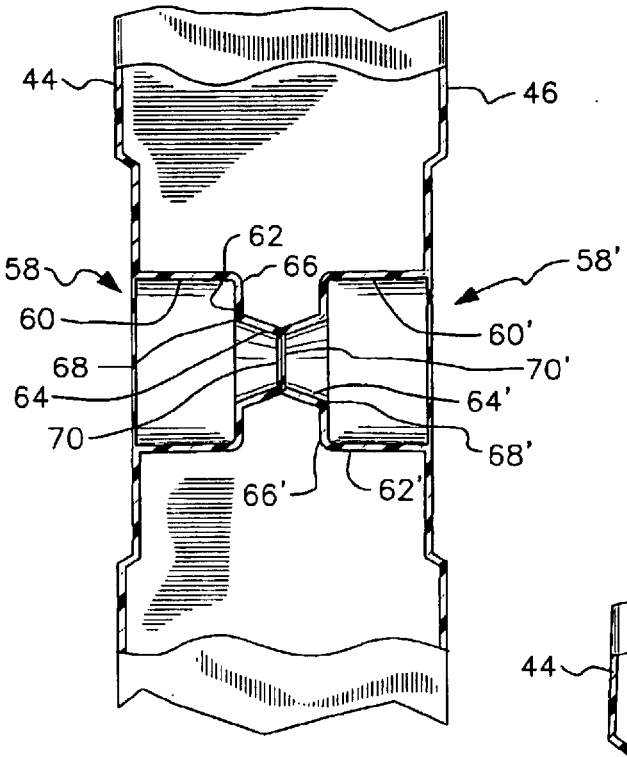
FIG. 9 is an end sectional view generally similar to that of FIG. 7, but of another embodiment of the bottle of this invention.
Figure 10:
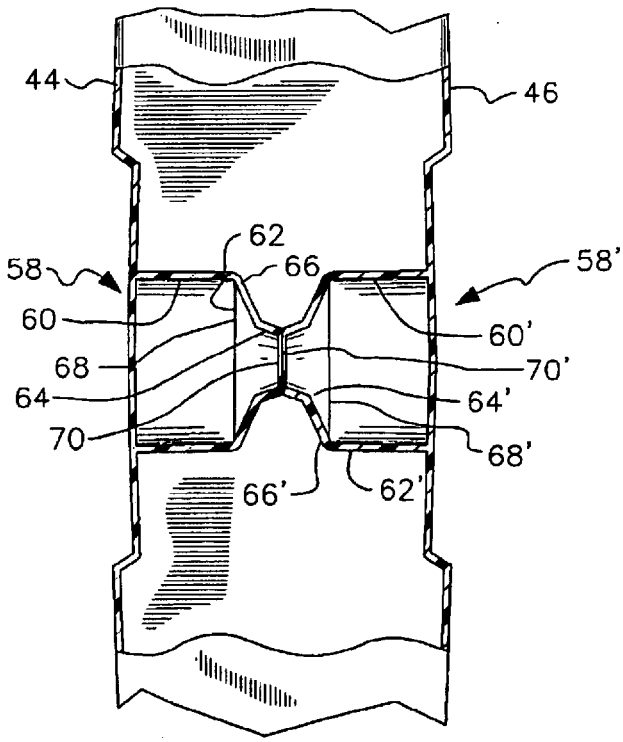
FIG. 10 is an end sectional view similar to that of FIG. 8, but illustrating the bottle of the embodiment of FIG. 9 in its expanded configuration.

FIGS. 9 and 10 illustrate a slight variation in the structure of the bottle of this invention from that shown in FIGS. 5 through 8. Specifically, the flexible portion 62 of this embodiment in its non-expanded position extends generally parallel to the side of the bottle, as shown in FIG. 8. When the sides of the bottle are deflected, this flexible portion 62 deflects to a more limited extent than shown in FIGS. 7 and 8. In all other respects, the structure of this embodiment is substantially the same as that shown in FIGS. 5 through 8.

Of course, it is to be understood that this invention is not to be limited to the specific structure illustrated. Obviously, a plurality of additional fold lines corresponding to those of reference numbers 66 and 68 could be provided in the flexible portion 62, somewhat like an accordion pleat, if desired. As noted above, the invention could be practiced with such a support member formed in only one of the two opposing sides of the bottle, with the end 70 of the support extremity extending all the way across to a generally planar opposing side, thus obviating the need for a second such support structure. Likewise, several such support structures could be incorporated at laterally spaced positions across the side of the bottle, either with corresponding mating supports, or with a support on one side extending all the way across to the opposing side. In this preferred embodiment, each opposing side of the bottle includes at least one such support, with those supports being positioned substantially opposite one another.

While the foregoing describes one particularly preferred embodiment of the bottle structure of this invention, it is to be understood that this description is illustrative only of the principles of the invention and is not to be considered limitative thereof. Since numerous modification and variations of this structure, all within the scope of the invention, will readily occur to those skilled in the art, the scope of this invention is to be limited solely by the claims appended hereto.

What is claimed is:

1. A plastic bottle of generally parallelepiped configuration having two opposed sides, a top with an opening, a bottom and two ends, at least one of said two opposing sides having integrally molded therewithin a reentrant beam support extending inwardly of said bottle and engaging the other said opposing side to provide support against deflection of said opposing sides relative to one another, said support having a first portion adjoining said one side and being of generally cylindrical configuration, with an annular, flexible portion joining said cylindrical portion to a support extremity of smaller cross section than said first portion, with said support extremity engaging said other opposing side, whereby the flexible portion permits a limited amount of deflection of the two opposing sides toward or away from one another.

2. The bottle of claim 1 wherein said flexible portion includes at least one fold line to enhance flexibility.

3. The bottle of claim 2 wherein said flexible portion includes a plurality of said fold lines.

4. The bottle of claim 3 wherein said fold lines are annular about said support extremity.

5. The bottle of claim 1 wherein said support extremity is of generally frusto-conical configuration.

6. The bottle of claim 1 wherein said support first portion is of generally frusto-conical configuration.

7. The bottle of claim 1 including at least two said molded supports.

8. The bottle of claim 7 wherein said extremity of each said molded support is bonded to said opposing wall portion.

9. The bottle of claim 7 wherein each said opposing side of said bottle includes at least one said support.

10. The bottle of claim 9 wherein said supports are positioned substantially opposite one another.

11. The bottle of claim 10 wherein the end of each said support extremity distal said flexible portion is affixed to the corresponding end of the respective said opposed support extremity.

* * * * *